US009107499B2

(12) United States Patent
Elwell

(10) Patent No.: US 9,107,499 B2
(45) Date of Patent: Aug. 18, 2015

(54) SECURE STORAGE UNIT

(71) Applicant: TBOX LIMITED, Newton Aycliffe (GB)

(72) Inventor: Jon Elwell, Gateshead (GB)

(73) Assignee: TBOX LIMITED, Newton Aycliffe (GB)

( * ) Notice: Subject to any disclaimer, the term of this patent is extended or adjusted under 35 U.S.C. 154(b) by 0 days.

(21) Appl. No.: 14/307,834

(22) Filed: Jun. 18, 2014

(65) Prior Publication Data

US 2014/0300256 A1 Oct. 9, 2014

Related U.S. Application Data

(63) Continuation of application No. 13/516,548, filed as application No. PCT/GB2010/052134 on Dec. 17, 2010, now abandoned.

(30) Foreign Application Priority Data

Dec. 17, 2009 (GB) ..... 0922019.5

(51) Int. Cl.

| | |
|---|---|
| ***E05B 65/46*** | (2006.01) |
| ***A47B 81/00*** | (2006.01) |
| ***B25H 3/02*** | (2006.01) |
| ***E05B 47/00*** | (2006.01) |

(Continued)

(52) U.S. Cl.

CPC ..... *A47B 81/00* (2013.01); *A47B 96/00* (2013.01); *B25H 3/028* (2013.01); *E05B 47/0002* (2013.01); *E05B 47/02* (2013.01);

(Continued)

(58) Field of Classification Search

CPC ..... E05B 65/462; E05B 65/463; E05B 65/46; E05B 47/0002; A61J 7/0076; A61J 7/0069; A61B 19/0248; A61B 2019/0249; A61B 2019/025; A61G 12/001

USPC ..... 312/215, 222, 348.3, 291, 209

See application file for complete search history.

(56) References Cited

U.S. PATENT DOCUMENTS

| | | | |
|---|---|---|---|
| 5,905,653 | A | 5/1999 | Higham et al. |
| 5,940,306 | A | 8/1999 | Gardner et al. |

(Continued)

FOREIGN PATENT DOCUMENTS

| | | | |
|---|---|---|---|
| DE | 202006002177 | U1 | 4/2006 |
| DE | 102007017207 | A1 | 2/2008 |
| GB | 2453977 | A | 4/2009 |

OTHER PUBLICATIONS

Radu, David, "International Search Report" for PCT/GB2010/052134, as mailed Jul. 22, 2011, 4 pages.

*Primary Examiner* — Hanh V Tran

(74) *Attorney, Agent, or Firm* — Winstead PC

(57) ABSTRACT

According to a first aspect, a secure storage unit includes a plurality of movable trays within a housing and is equipped with a tray selector system for selectively accessing a tray on demand, wherein the selector system is configured to release a selected tray for access by limiting the allowable extent of movement of the tray from a stowed to an accessible position with respect to the storage unit by a pre-determined amount whereby access to selected zones of selected trays is controlled. In an embodiment of the secure storage unit, the selector system includes a plurality of discrete electromechanical locking devices operably juxtaposed with respect to the trays, and configured to be individually selectable for releasing and limiting the allowable extent of movement of the selected tray with respect to the storage unit.

20 Claims, 12 Drawing Sheets

(51) Int. Cl.
*E05B 47/02* (2006.01)
*A47B 96/00* (2006.01)

(52) U.S. Cl.
CPC ..... *E05B 65/46* (2013.01); *E05B 65/462* (2013.01); *E05B 2047/0008* (2013.01)

(56) References Cited

U.S. PATENT DOCUMENTS 6,011,999 A 1/2000 Holmes
6,065,819 A 5/2000 Holmes et al.
6,338,007 B1 1/2002 Broadfield et al.
7,909,418 B2 3/2011 McFarland
8,019,470 B2 9/2011 Meek, Jr. et al.
8,103,379 B2 1/2012 Biba et al.
8,335,588 B2 12/2012 Rahilly et al.
2002/0067108 A1 6/2002 Doan et al.
2003/0001466 A1 1/2003 Herrington
2004/0061418 A1 4/2004 Yoo
2004/0104652 A1 6/2004 Holmes et al.
2006/0175942 A1 8/2006 Meek et al.
2008/0157642 A1 7/2008 Liu
2009/0204254 A1 8/2009 Weber
2009/0224638 A1 9/2009 Weber
2010/0176917 A1 7/2010 Bacarella

SECURE STORAGE UNIT

This patent application is a continuation of, and incorporates by reference the entire disclosure, of U.S. patent application Ser. No. 13/516,548, which is a national-stage filing of International Patent Application No. PCT/GB2010/052134. International Patent Application No. PCT/GB2010/052134 was filed on Dec. 17, 2010. International Patent Application No. PCT/GB2010/052134 is incorporated by reference in its entirety.

FIELD OF THE INVENTION

This invention relates to a secure storage unit with smart access capability whereby items stored in the unit are accessible under a control system operable via a user interface.

Such a storage unit will be useful in electronic service delivery, and can offer advantages in supporting "just in time" production, dispensing of medicines, delivery of parts for medical devices, improved stock control of small readily confusable items like semiconductor chips, etc.

The invention will be described in the context of storage of replacement parts for ease of discussion, but it has a wider utility and is adaptable to many purposes where security, certainty and exactness in retrieval of stored items from a storage system are important.

BACKGROUND TO THE INVENTION

In many fields there is a need to store items, which may be consumables, spare parts, auxiliary replaceable parts for changing the performance capability of a piece of apparatus etc. It is essential when such an item is retrieved from the storage facility that it is fit for purpose, i.e. its specification is appropriate for the intended usage and it is not confused with a similar item of differing specification. It is therefore desirable to devise a system which can reliably deliver the correct retrieval of items from a storage facility. It is also of importance that only authorised competent persons gain access to the stored items, and so secure storage permitting access only to an authorised user is contemplated.

SUMMARY OF THE INVENTION

The invention to be more particularly described hereinbelow provides a secure storage unit, an operating system for accessing the unit, and unique storage sub-units to be used in conjunction with the secure storage unit.

The secure storage unit may be a cabinet, and the storage sub-units may be trays or drawers, optionally provided with movable covers or lids. The various aspects of the invention will be described generally for simplicity with reference to the provision of a tray as a suitable form of storage sub-unit.

According to a first aspect of the invention a secure storage unit comprising a plurality of movable trays within a housing is equipped with a tray selector system for selectively accessing a tray on demand, wherein the selector system is configured to release a selected tray for access by limiting the allowable extent of movement of the tray from a stowed to an accessible position with respect to the storage unit by a predetermined amount whereby access to selected zones of selected trays is controlled.

In an embodiment of the secure storage unit, the selector system comprises a plurality of discrete electromechanical locking devices operably juxtaposed with respect to the trays, and configured to be individually selectable for releasing and limiting the allowable extent of movement of the selected tray with respect to the storage unit.

The sub unit may be a tray with a plurality of n wells therein for respectively receiving n items, and where such a tray is selectively released for access, a limited number of such wells are exposed for access. Thus for example where the wells are in a regular two dimensional array of x rows and y columns, upon first access demand the tray is released and stopped to expose only the first row of wells and thus reveal $n-[(x-1)y]$ items. Assuming that during such access the item that is to be removed from storage is removed from a well, and that each item in the first row is identical, then after a predetermined number of access steps (having a value y equal to the number of wells in a row), the allowable extent of movement can be adjusted by a predetermined amount to permit the tray to be exposed for access to the extent necessary to admit access to the next row.

In a variant of the invention according to the first aspect, the tray is a compartmentalized drawer, wherein each compartment is configured to receive an item for storage.

In a preferred variant of the invention, the tray or drawer has a securable cover or lid for providing additional control over access to the tray or drawer. Preferably, when considering an array of wells or compartments in x rows and y columns, the cover or lid may be sub-divided into y' sections which are individually controllable to limit access to a column. This feature in addition to the access control already present by limiting the extent to which rows are exposed for access by limiting the allowable extent of movement of the tray from a stowed to an accessible position with respect to the storage unit further improves access control. Thus for example although a first row of items might be presented in an exposed part of the tray projecting from the storage unit, only one item can be removed from the exposed row where the column is uncovered by retention of the cover or lid section within the storage unit, and adjacent cover or lid sections are not retained and remain locked in place to prevent access to adjacent items to that which can be removed.

It is envisaged that in such an embodiment, a tray with a lid subdivided into discrete sections by slot division allows sections to be selectively locked or released by electromechanical means, for example whereby upon access to a sub unit, a selected one (or more) of the sections is retained in position within the storage unit as the tray is released to emerge therefrom by a controlled extent. Thus to the user it appears that as the tray (or drawer) is ejected from the storage unit, the cover section for the selected item is retracted.

It will be understood that linear arrays of wells or compartment are discussed for convenience, and that in practice, other more complex configurations of sub-division of sub-units can be devised to accommodate items of different shapes or irregularly shaped items. The same principle of controlled release of the tray by a limited extent from the storage unit applies to limit access to certain zones of the sub-divided tray. In combination with a predetermined limit on how far the tray is permitted to emerge from the storage unit, the use of lids which are individually and selectively releasable to a controlled extent provides exceptional secure access control.

Access to the storage unit by use of the tray selector system for selectively accessing a tray on demand may be on the basis of control of electromechanical locking means alone whereby a tray is released for manual movement from a stowed to an accessible position, or the selector system can be associated with a powered actuator system whereby the tray is advanced by a controlled amount by an actuator operably linked to that tray and configured to respond to predetermined commands from a system controller. In this way the actuator can be operated as a limit stop. Thus a combination of electromechanical devices such as solenoids and linear actuators can be adopted in a secure access selector system.

According to a second aspect of the invention a secure storage unit comprising a plurality of movable trays within a secure housing is equipped with a tray actuator for selectively moving a tray on demand, wherein the actuator is operably linked to the selected movable tray to move it from a stowed to an accessible position with respect to the storage unit, and controlled in a predetermined way by a processor unit, and each tray has a securable cover or lid for providing additional control over access to the tray, wherein the securable cover or lid is configured to interact with discrete electromechanical locking devices associated with the trays whereby the securable cover or lid is held in place or released for movement with respect to the storage unit.

The tray actuator may be controlled in the predetermined way by the processor in response to input from a user via an interface or in response to commands from an external control system.

The processor unit may be located within the storage unit.

The actuator may be of the gas strut type, or a mechanical or hydraulic type. An electro-mechanical device using a stepper motor can also be utilized to provide incremental movement of the tray with respect to the storage unit.

Each tray may be selectively electromechanically operated for access and storage purposes. The electromechanical operation steps are preferably controlled by a central processor or the like controller unit in response to input from a user interface. The central controller unit may be operable according to a pre-determined sequence to enable release of items within the secure parts storage unit in an ordered fashion, for example to correspond to a proposed item assembly sequence. The unit may be programmed to deny access to any part for the item when any one or more of the parts required for assembly of the item is "out of stock" or missing from the secure storage unit. This avoids incomplete assemblies or defective assemblies being created by a user unfamiliar with the correct item assembly protocol.

The secure storage units may be used individually, or linked in a system of such secure storage units. One such secure storage unit may be equipped with a central control unit that is enabled to distinguish and control a plurality of slave storage units which may be proximate or remote with respect to the central control unit.

Each tray may be equipped with sensors to sense one or more of the following: a physical interaction with the tray by a user such as a push or pull upon the tray, an insertion or removal of an item, and a non-allowed intervention such as forced access to the unit.

The control steps may include an open on demand step, and a close on command step, or a close after a timed interval, or a delay close in response to removal of an item, or a close in response to push pressure sensed upon the tray, or a combination thereof. For example, in normal operation a user may use the interface to input a demand for opening of a tray, and then input a command for closure of the tray, but in the absence of the input command, after a suitable delay, an automatic timed closure is effected in case the user forgets to input the command for closure after removing an item from the tray. Optionally, the open on demand step may be initiated by a physical action by the user upon the tray being sensed and triggering an electromagnetic or electromechanical operational step to move the tray to an accessible position.

Each tray may be compartmentalized and each compartment may be accessible via a lockable closure such as a cover plate or lid. The lockable closure may be a slidable lid which extends over one or more than one compartment in the tray.

The lockable closure may comprise a part that interacts with an electromechanical device which when energized effects a change in locking status.

Preferably, the lockable closures are configured for selective operation such that when one lockable closure is open, each other lockable closure is locked and cannot be opened.

The compartments may be of uniform size or may be of non-uniform size. The compartments may be grouped according to size, or arranged to maximize use of storage space having regard to the "footprint" of items to be stored therein, or arranged to facilitate ordered assembly of items into a complex item. The compartments may have movable dividers to allow size to be varied. The compartments may be arranged upon a single base surface and each tray may comprise a similar such single base surface.

In an embodiment of the invention, the storage unit is a cabinet and the sub units are either trays with wells for receiving items or compartmented drawers within the cabinet. In alternative embodiment, the tray is adapted to support various modular compartmented containers e.g. of differing widths side by side so that moving across the width of a tray progressively, wider compartments are presented (for example), but moving from front to rear of the tray the compartments are of uniform size. In this way different sized items a, b, c, d, . . . n can be accessed in a first access step, and in a successive access step an identical item a', b', c', d', . . . n' for example in a repeat order can be accessed by an incremental movement of the tray beyond the first.

According to a third aspect of the invention a secure parts storage unit comprises a housing including structural frame, a base, side walls, a platform for hardware, and a securable top cover, and a plurality of trays locatable within the frame and enclosed by the housing, and mounted for movement within the frame from a stowed to an accessible position with respect to the storage unit, wherein each of said tray or drawer units is connected to a control system for selectively limiting movement of each tray on demand from a stowed to an accessible position with respect to the storage unit, by a controlled incremental amount sufficient to allow release of at least one part stored on the tray.

Preferably the release of the part is enabled by relative movement of a cover section for the tray with respect to a zone on the tray where the part is stored, after the selected tray has been moved by an incremental amount.

The sub units may be trays and/or drawer units as contemplated for the first and second aspects of the invention.

According to a fourth aspect of the invention a movable tray for a secure part storage unit comprises a tray surface configured to receive a plurality of items in discrete zones, and a cover for the tray surface that is divided into discrete sections each corresponding to the width of the discrete zones, wherein each section is independently translatable with respect to the zones to permit access from above the zones.

Preferably, the movable tray is adapted to be mounted in a secure part storage unit on runners to allow the unit to be moved as a drawer.

The movable tray may be connectable to an actuator, such as a gas strut actuator, or the like linear actuator as discussed hereinbefore. The connection may be made at the rear of the tray to allow the tray to be pushed out of the secure part storage unit or retracted according to the access requirements of a user.

The runners may be inclined to facilitate movement of the tray within the storage unit e.g. when the tray is returned to storage.

In embodiments of the tray, the relative translational movement of the cover with respect to a corresponding tray surface zone is controllable for use within a storage unit, by use of a combination of electromechanical and magnetic devices. For example a solenoid can be juxtaposed with respect to the tray, and when energised allows the tray to be released from a retained position, and further solenoids appropriately positioned with respect to the cover sections can be independently operated to release only one section for access purposes. The released section can be captured within the storage unit by use of magnetic retention means, for example electromagnets which are selectively enabled with respect to the appropriate section covering a tray zone to be accessed by a user.

The invention in its various aspects will now be further described by way of example with reference to the accompanying drawings.

DESCRIPTION OF EMBODIMENTS OF THE INVENTION

Figure 1A:
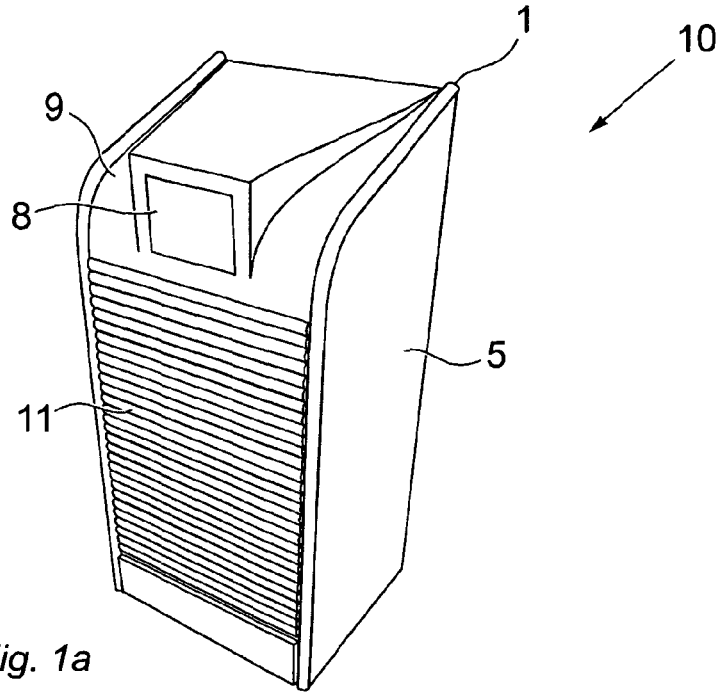
FIGS. 1*a* and 1*b* show respectively a perspective view from the front and to one side of a secure storage unit of the invention, and the same secure storage unit with internal storage sub units, front wall, side wall, back wall and top cover removed.
Figure 1B:
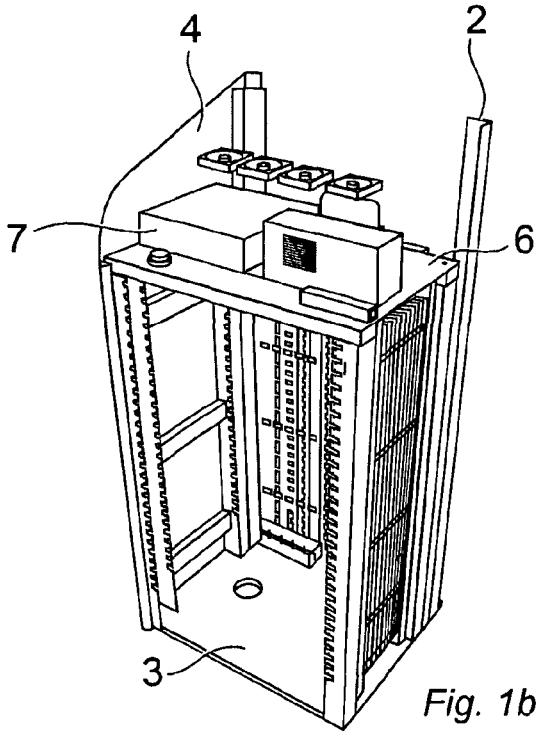

Referring to FIG. 1, a secure parts storage unit 10 comprises a housing 1 including structural frame 2, a base 3, side walls 4, 5, a platform 6 for hardware 7, including a user interface 8 which in this embodiment comprises a touch screen, and a securable top cover 9, and a plurality of trays 11 locatable within the frame 2 upon runners and enclosed by the housing 1.

The upright structural frame 2 provides support for the trays 11 and also in combination with the base 3 and hardware support platform 6 provides form and strength to the secure housing 1. Optionally, there may be a freely accessible space (not shown) below the base for storage of equipment, additional hardware or tools. Alternatively such clearance space below the base 3 may be utilised for access by a lifting device such as a pallet truck to allow the unit 10 to be relocated.

The hardware 7 includes a central system controller (not shown) that is configured to process input from the interface and to execute commands to operate components of the storage unit 10 in a pre-determined way.

Figure 2:
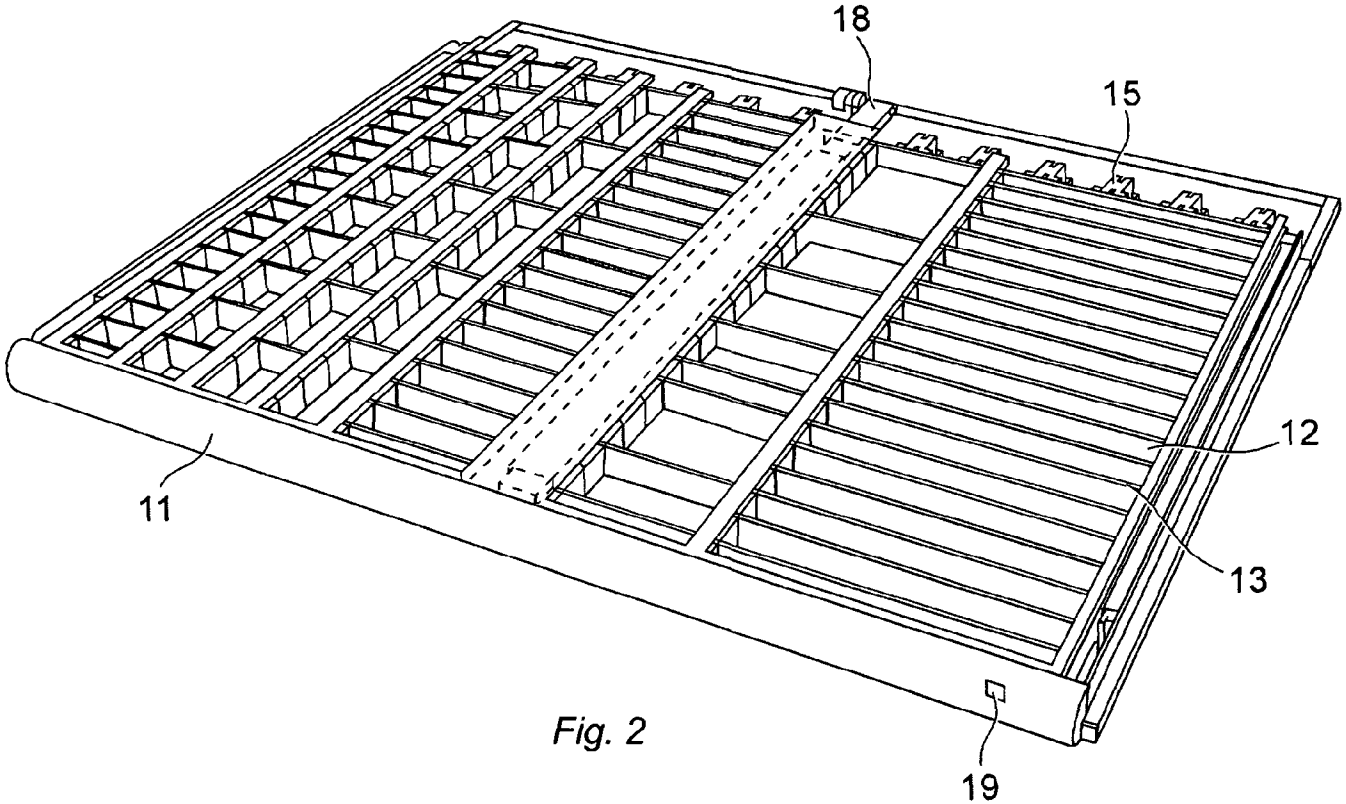
FIG. 2 is a perspective view from above of an embodiment of a movable tray which is suitable for use in the secure storage unit shown in FIGS. 1*a* and 1*b;*

Referring to FIG. 2, the tray 11 has a surface divided into compartments 12, by relocatable dividers 13, wherein the compartments 12 are sized to accommodate parts to be stored (not shown). These compartments are enclosed by the cover lid which is divided into individually translatable sections 16. Each such section 16 is captive and slidable within longitudinal edge-overlapping retainers fixed at front and rear edges of the tray 11, which thereby prevent the sections 16 being lifted and also act as guides to ensure repeated accurate repositioning of the sections 16 as the tray 11 is extended and retracted. An LED 19 is presented on the front of the tray 11 to provide a visual indicator when the tray is accessible.

The trays may be restrained against removal from the housing by provision of front/rear limit stops (not shown) within the frame of the housing.

The illustrated tray 11, in this embodiment can be considered as a two-dimensional x-y arrangement of zones of differing sizes wherein seven columns respectively containing compartments of the same size to accommodate parts of identical footprint. Due to these differing sizes of compartments in the illustrated tray there is no uniformity row upon row. In other embodiments, the uniform size may be in rows and the different sized zones may be per column. In still further contemplated embodiments a regular array of compartments is present.

Figure 3:
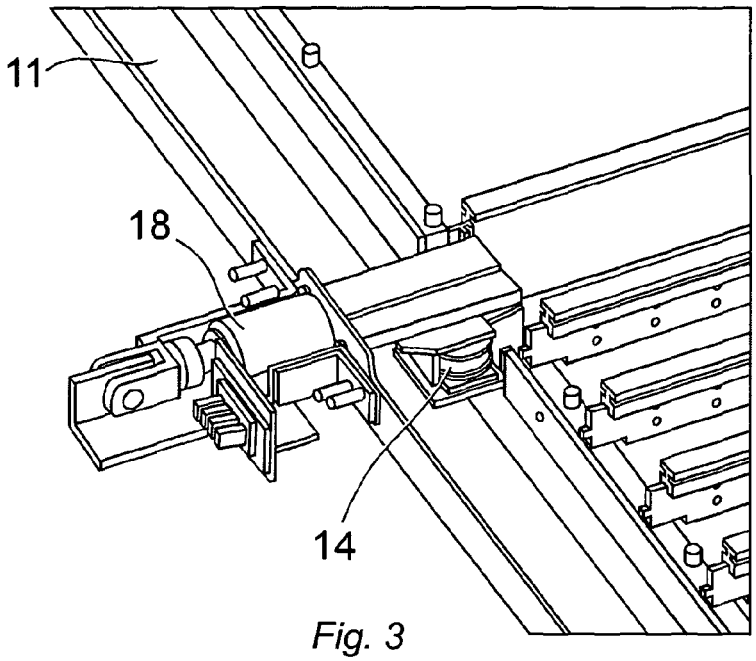
FIG. 3 is an enlarged view of part of the tray shown in FIG. 2, showing detail of an actuator.
Figure 4:
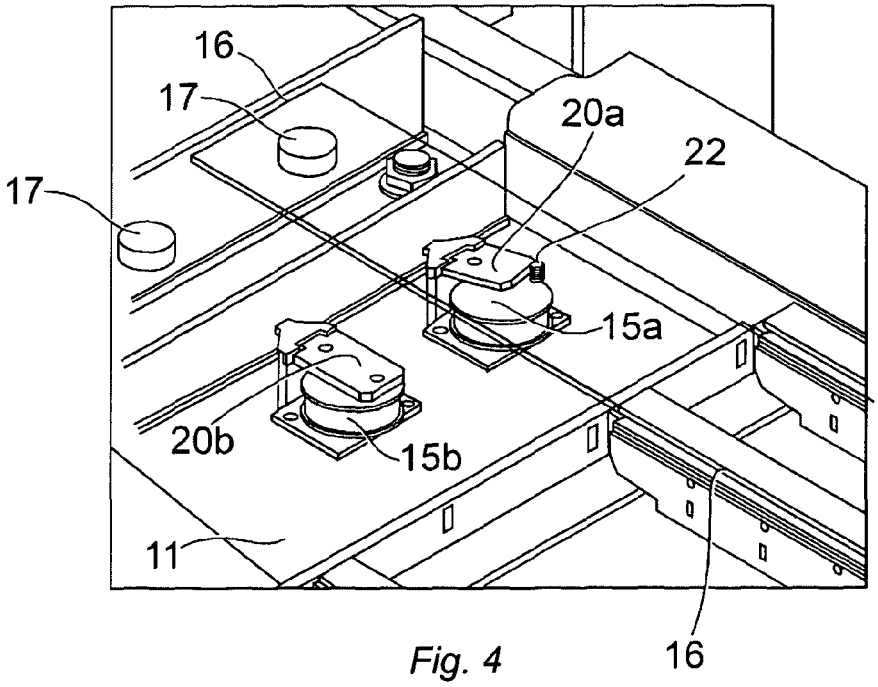
FIG. 4 is an enlarged view of part of the tray of the type shown in FIG. 2, with cover and showing detail of magnetic cover retention means.

Referring to FIGS. 3 and 4, at the rear of the tray 11, a plurality of solenoids 14, 15*a*, 15*b* are arranged to independently provide for selective locking and release of the tray 11 (by solenoid 14), and the slidable sections 16 (by solenoids 15*a*, 15*b*). The solenoids shown have flappers 20*a*, 20*b*. In FIG. 4, solenoid 15*a* is non-energised, so flapper 20*a* is spring biased to be raised and it retains the translatable slide cover section 16 by abutting against the slide cover retaining bolt 22, which is affixed to the translatable slide cover section 16. Solenoid 15*b* is shown energised to lower the flapper 20*b*. Additionally, magnets 17 are juxtaposed with the translatable sections 16 to enable selective retention of an unlocked slidable section 16 within the storage unit 10 when a tray 11 is released for access purposes.

In this embodiment the tray 11 is operably connected to a linear actuator 18 comprising a gas strut drive which, with the solenoid 14, allows the tray 11 to be extended from the secure storage unit 10 by a controlled amount for access, and retracted after access is completed. The actuator 18 is connected centrally at the rear of the tray, and concealed within the housing 1 in normal use of the storage unit 10.

Operation of the secure storage unit requires a user to interact with the secure storage unit 10 via the user interface 8 e.g. by touching the screen at appropriate positions. The input generates a command to open a tray 11, and the controller effects the following operational tasks. A solenoid 14 is energized to change the status of a locking component to release a selected tray for access. Other solenoids 15*a*, 15*b* associated with the translatable cover sections 16 are controlled such that certain ones are non-energized to maintain a locked status, and a selected solenoid is energized to unlock a selected translatable cover section 16. A magnet 17 associated with the selected translatable cover section 16 is utilized to restrain the translatable cover section within the secure storage unit 10 as the tray 11 is opened by the action of the linear actuator 18. This presents the user with a tray in which certain compartments 12 remain covered by the locked cover sections 16, and a selected compartment 13 is accessible. In this way only the requested part is retrievable from the secure storage unit according to the input. After the part is retrieved the tray 11 is retracted by the actuator 18 in response to an action by the user such as a push on the tray edge or by a system response (time-delay switching) or the tray 11 is closed manually by the user pushing the tray 11 closed to complete the transaction.

The following sections describe the main component of a drawer assembly and explain how each component operates in accordance with user input and software signals.

1 Drawer Components and Draw Opening/Closing Procedures 1.1 Drawer Assembly Components.

Figure 5:
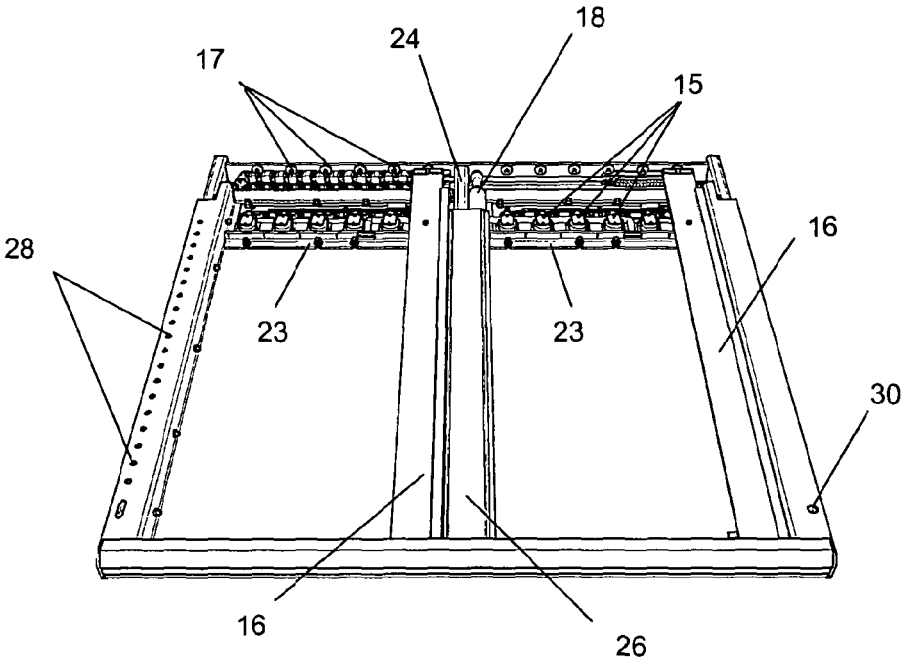
FIG. 5 is a perspective view from above of the moveable tray assembly components.

FIG. 5 is a perspective view from above of the moveable tray assembly components. The components shown are: slide cover retaining magnets 17, slide cover solenoids 15, slide covers 16, drawer assembly printed circuit boards (PCBs) 23 on which the solenoids 14, 15 are mounted, the drawer ratchet mechanism 24, the gas strut 18 with its cover 26, drawer position cutouts 28 and a drawer closed position cutout 30.

1.2 Drawer Assembly (Closed Position)

As shown in FIG. 5, when in the closed position the slide covers will be in the fully closed position with the slide cover retaining magnets 17 retaining the slide covers 16.

Figure 6:
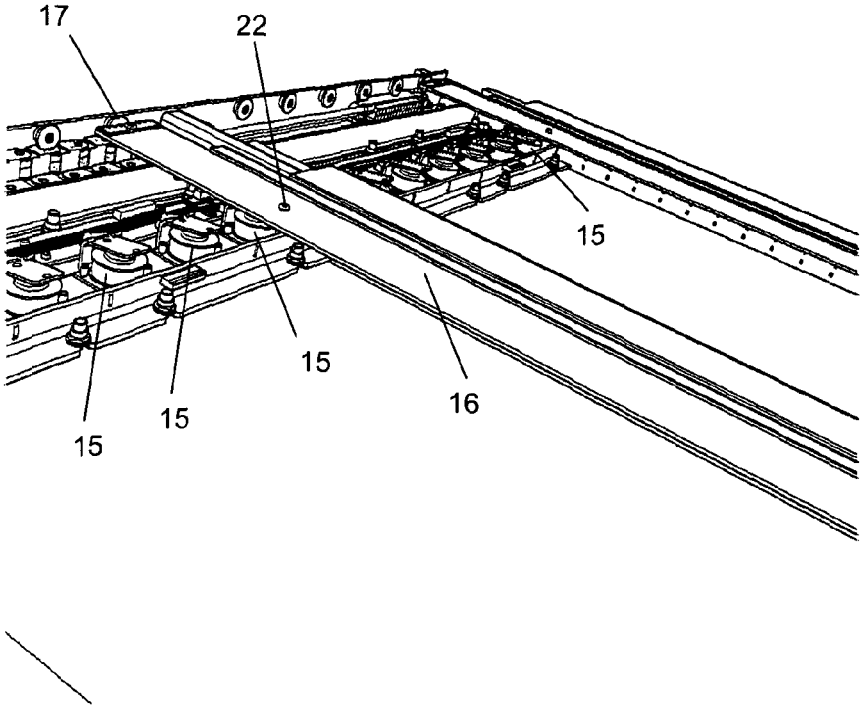
FIG. 6 is a perspective view of a drawer assembly showing non-energised slide cover solenoids retaining slide covers.

FIG. 6 is a perspective view of the rear of a drawer assembly showing non-energised slide cover solenoids 15 retaining the slide covers 16. All slide cover solenoid's 15 are typically non-energised when the drawer is in the closed position.

Figure 7:
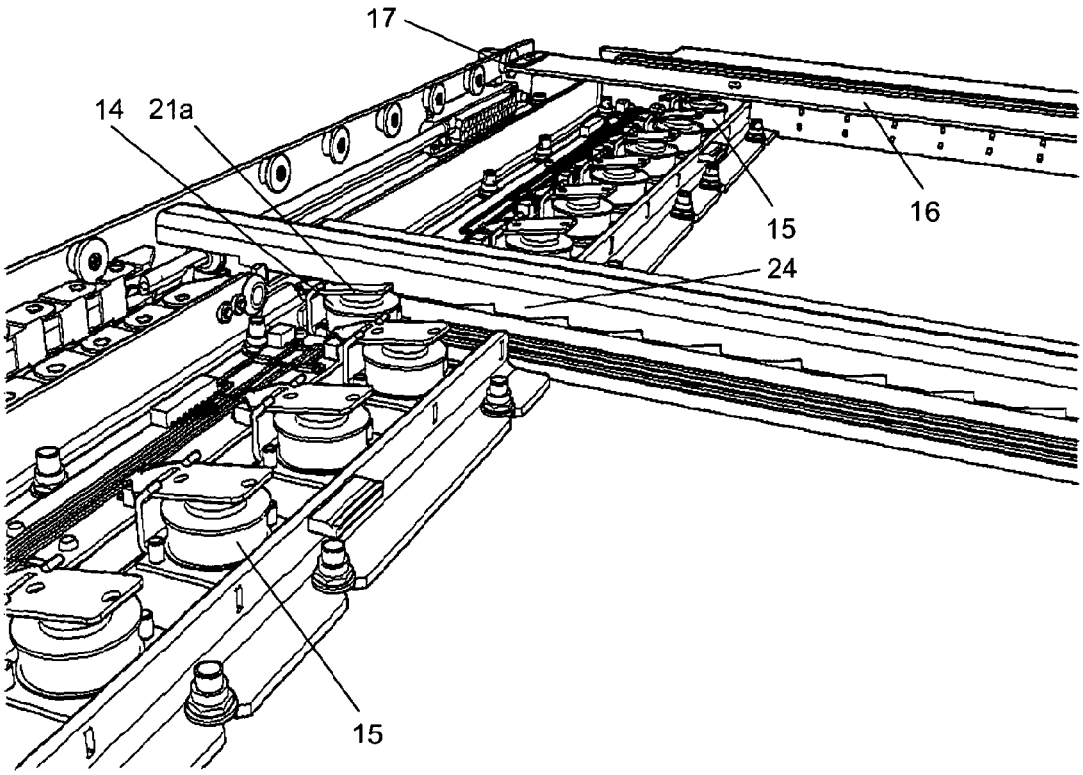
FIG. 7 is a perspective view of a drawer assembly showing non-energised drawer ratchet solenoid retaining the drawer assembly in the closed position.

FIG. 7 is a perspective view of the rear of the drawer assembly, with most slide covers not shown, with the non-energised drawer ratchet solenoid 14 retaining the drawer assembly in the closed position. As the solenoid 14 controlling the drawer ratchet 24 is also non-energised with its flapper 21*a* up against the ratchet mechanism 24 retaining the drawer in the closed position.

1.3 Drawer Operation (Closed Position)

As discussed above, FIG. 7 shows the initial position of the drawer when in the fully closed position. The ratchet retaining solenoid is non-energised holding the drawer in the fully closed position. Each slide cover retaining solenoid 15 is non-energised holding the cover slides in the fully closed positions.

1.4 Drawer Operation (Opening)

Figure 8:
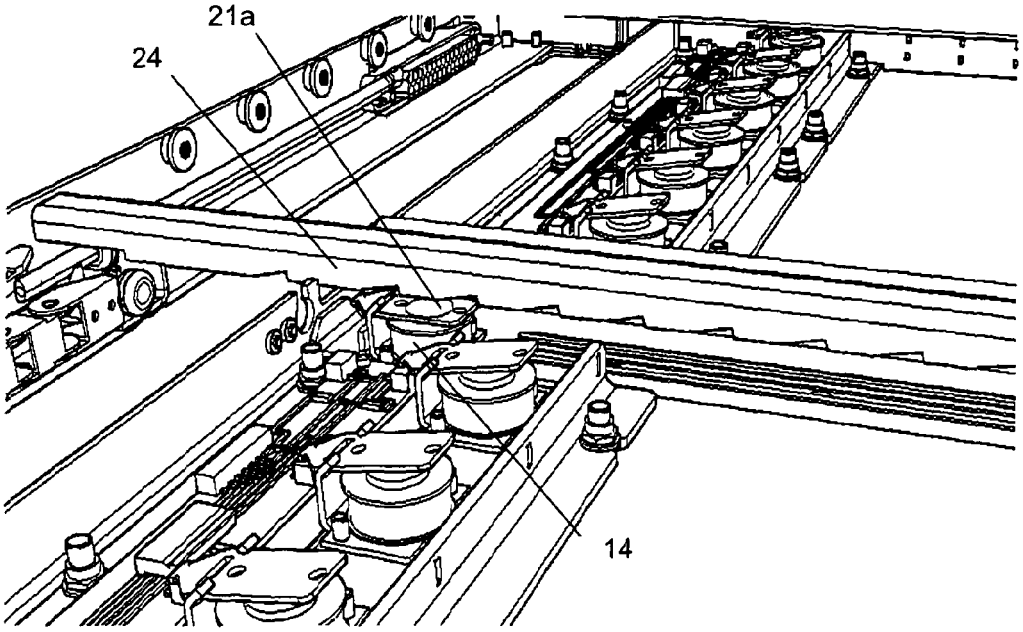
FIG. 8 is a perspective view of a drawer assembly showing the drawer when initiating a parts withdrawal.

FIG. 8 shows the drawer when initiating a parts withdrawal. When the user initiates a parts withdrawal an electronic signal is sent to a selected drawer unit. This signal illuminates the LED light on the front of the drawer containing the users parts and sends a signal to the ratchet and cover slide solenoids 14, 15. The selected cover slide solenoid 15 (not shown in FIG. 8) is energized lowering its flapper and allowing the cover slide to be retained by the respective rear magnet 17 and to move freely within the cover slide compartment as the drawer is opened.

Immediately after the selected cover slide solenoid 15 energises, or simultaneously, the ratchet solenoid 14 energises allowing the drawer gas strut to push the drawer to a pre-defined position. This is reached when a laser sensor counts the position holes 28 on the drawer and de-energises the ratchet solenoid 14 to engage the ratchet mechanism 24 at the appropriate position. The position the drawer opens depends on the pre defined position assigned within the controlling software application.

Because the user pushes the drawer and removes pressure against the ratchet 24 from the ratchet solenoid flapper 21*a* so that it is pulled down, when the user then releases the drawer the gas strut can push the drawer unit open to an allocated position.

1.5 Drawer Opening (Light Sensor Operation)

Figure 9:
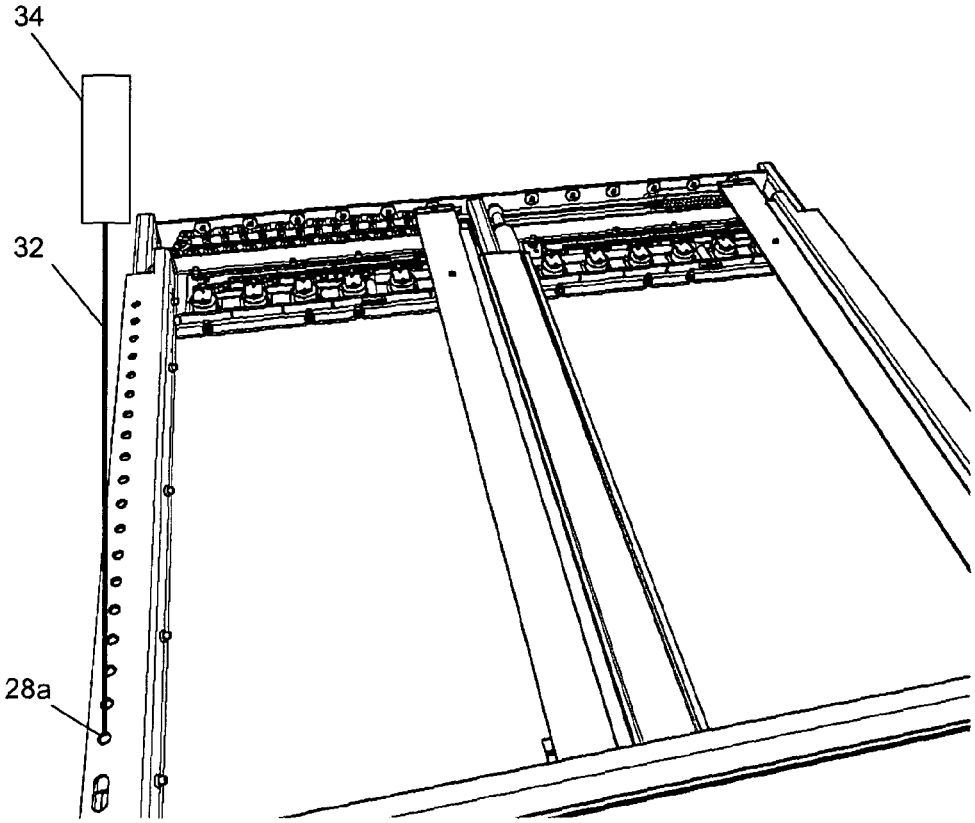
FIG. 9 shows the operation of the laser position sensor.

FIG. 9 shows the operation of the laser position sensor. Just as the drawer starts to open the laser beam 32 emitted by the laser 34 passes throughout the first position cutout 28*a*.

As the drawer opens, the laser beam begins to be repeatedly interrupted and a light sensor at the bottom of the storage unit (not shown) starts to count the number of drawer position cut-outs. As only one drawer opens at a time, all the remaining drawer cut-outs are aligned so allowing the laser beam to pass through all the drawers. This has the advantage that only one position sensor is needed to measure the position of all drawers, rather than having one sensor per drawer.

Figure 10:
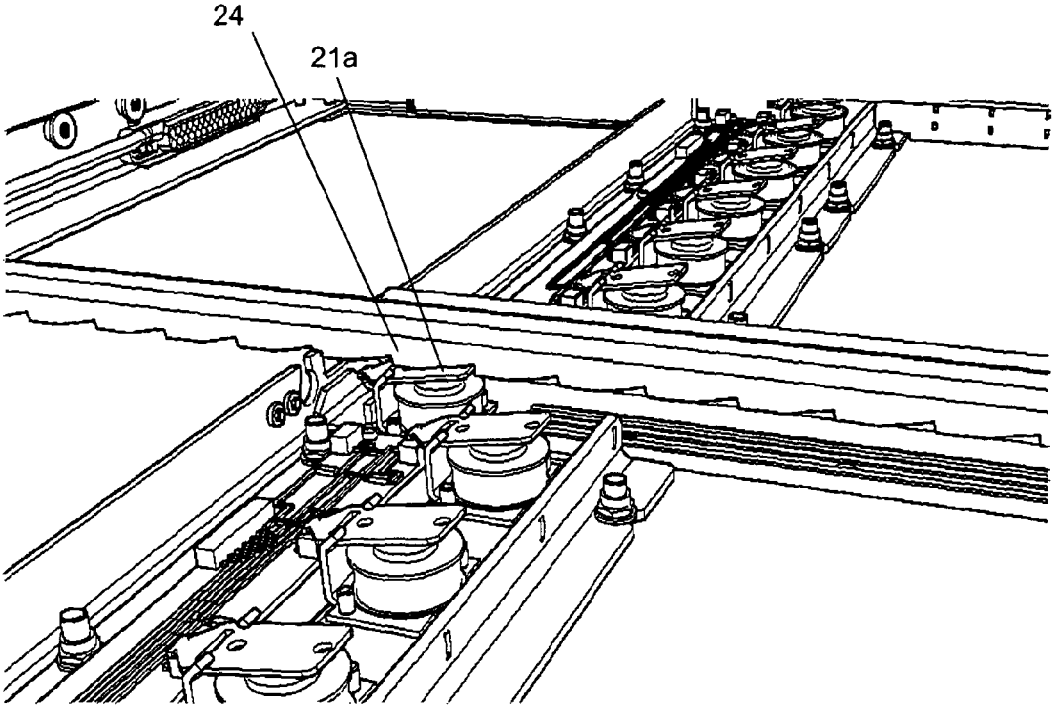
FIG. 10 shows the ratchet solenoid capturing the drawer at the predetermined position.

FIG. 10 shows the ratchet solenoid capturing the drawer at the predetermined position. With reference to FIG. 10, when the light sensor counter reaches the position specified by the controller software, a signal is sent to the ratchet solenoid. When the signal is sent to ratchet solenoid the solenoid flapper 21*a* moves from the energized position to the non energised position to engage the ratchet mechanism 24. This captures the drawer in the correct position to allow the user to remove the desired parts.

1.6 Drawer Opening (Slide Cover Operation)

Figure 11A:
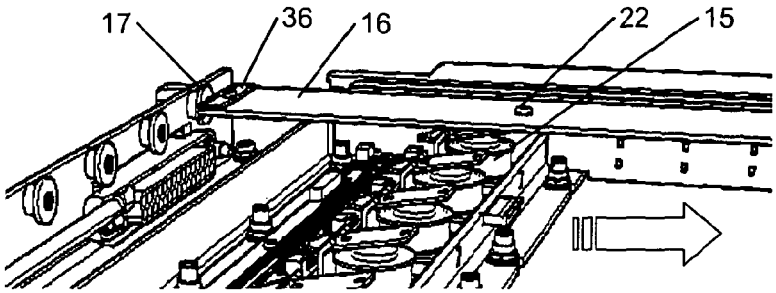
FIGS. 11*a* to 11*c* shown the retained slide cover during movement of the opening drawer.
Figure 11B:
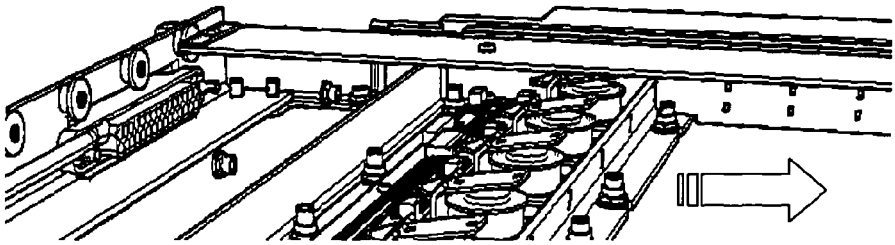
Figure 11C:
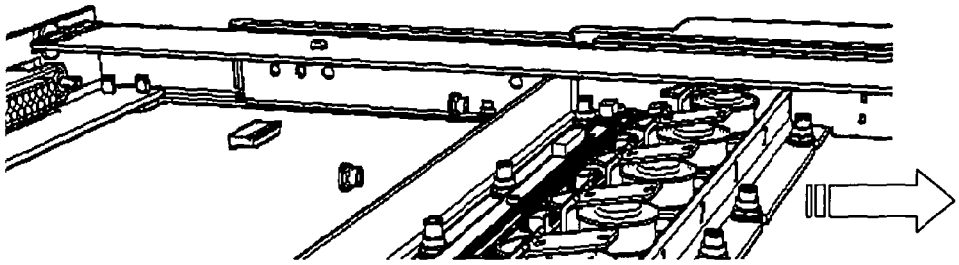

FIGS. 11*a* to 11*c* shown the retained slide cover during movement of the opening drawer.

With reference to FIG. 11*a*, when the user pushes the drawer to initiate the gas strut, the metallic retaining tab 36 located at the rear of the cover slide 16 becomes magnetised to the slide cover retaining magnet 17.

The cover slide solenoid becomes energised releasing the solenoid flapper allowing the slide cover retaining bolt 22 to disengage from the solenoid.

When the user removes pressure from the drawer the cover slide retaining magnet holds the slide cover in position whilst the drawer opens to a pre defined position as specified by the controlling software application. This is shown in FIGS. 11*b* and 11*c*.

1.7 Drawer Closing

When the user has removed the allocated parts from the drawer the drawer is ready to be pushed into the closed position.

The user exerts pressure to the centre of the drawer which will make the ratchet solenoid flapper depress whilst non-energised against its spring. The flapper will catch each ratchet tooth until it reaches the final ratchet position. This being the drawer fully closed position. At this point the LED lights on the front of the drawer will go out.

1.8 Draw Closing (Slide Cover Operation)

When the user pushes the drawer to the closed position the drawer moves freely with respect to the slide cover until the drawer is fully closed. The cover slide stopping bolt 22 rides over the non-energised solenoid 15 and returns to the fully closed position, the solenoid again preventing the cover slide from moving with respect to the tray. When the drawer ratchet solenoid reaches the final tooth on the ratchet it locks the drawer in the closed position.

1.9 Drawer Closing (Drawer Closed Sensor)

Figure 12:
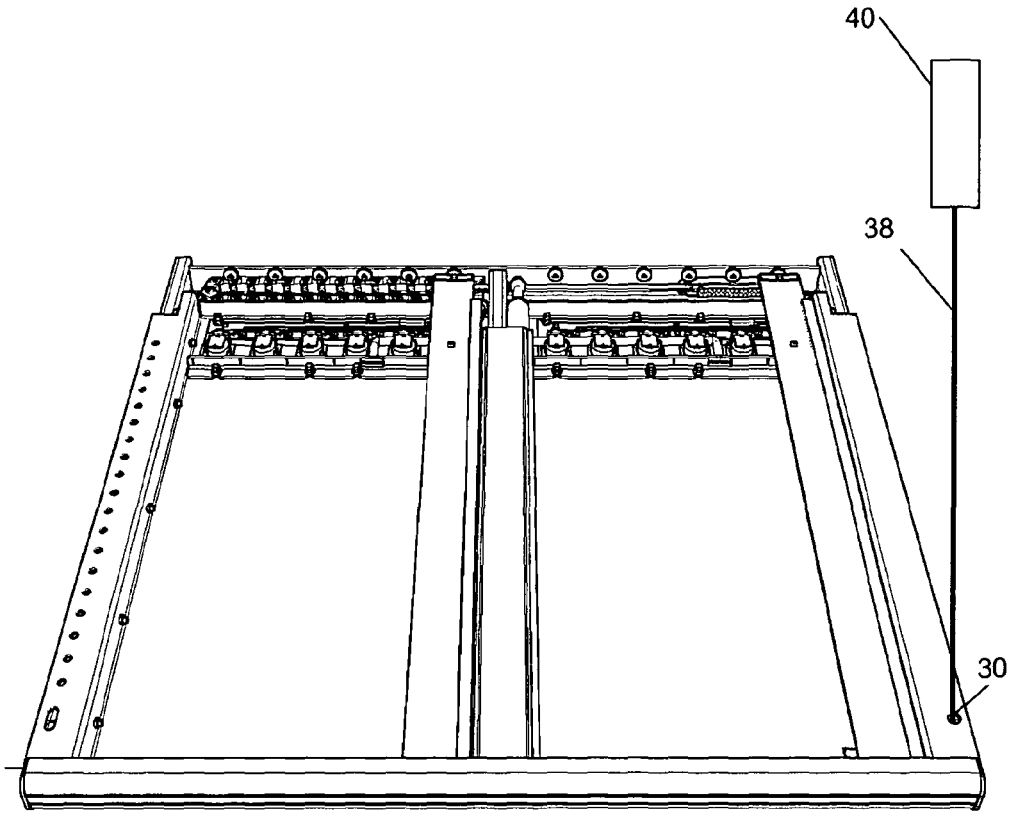
FIG. 12 shows the operation of the laser drawer closed sensor.

FIG. 12 shows the operation of the laser drawer closed sensor. When the drawer is pushed to the closed position by the user, the draw closed laser sensor activates when a laser beam 38 emitted by a laser 40 breaks through the drawer closed cut-out 30 located at the right hand side of the drawer unit. This confirms the fully completed transaction to the system.

In another embodiment, the above described secure storage unit is linked to a number of adjacent units which do not have any interface or user accessible system controls. In this embodiment, the aforesaid secure storage unit serves as a "master" and is operably connected to the other "slave" units to effect control thereof. As before, the user interacting with the "master" via a user interface is informed by on screen display or by signaling means on the trays as to in which unit the stored parts to be retrieved are located and which tray is to be extended for access to the parts.

Optionally the secure storage unit can be an isolated stand alone unit or it can be linked by a network or wireless technology to other systems. Such provides opportunities for stock control in a distribution network including a central manufacturing or supply facility and a number of remote user accessible secure storage units.

Many other opportunities arise when using the master/slave configuration. For example a master unit can authorise remote slave units to dispense parts to remote workers under the direction of a supervisor who is the authorised user of the master unit.

In a projected typical use of the secure storage unit or storage unit system, a user is likely to approach the secure storage unit to interact with the interface, and log in to pass security protocols and be admitted for access to the secure storage unit. The software presents the admitted user with an on-screen display of menu options which are responsive to touch or pointing, enabling the user to inform the system as to the access requirements. The software responds by display of the requested selections, and the user responds by confirming the selections to be made. The software may enable a visible display to signal the initiation of the access process, e.g. in a simple case by energizing an LED on the selected tray to be accessed or by causing an audible tone to be emitted. This allows the user to step back from the interface to await access to the selected tray(s). It is envisaged that where more than one tray is to be accessed this will happen sequentially so that each accessed tray is secured again before the next is accessed.

The access time per step of the process for retrieval of the respective parts for the tray can be open and controlled by user interaction e.g. pushing on the front edge of the tray after retrieving the required part(s). Alternatively, the tray may be provided with sensors to detect removal of a part and the tray returned to storage after a suitable time period initiated by the sensed removal. As a further alternative the user may be informed of the time delay for removal of parts at the outset when logging in and subsequently advised of a time-out closure action for the open tray e.g. by use of an audible tone, or a visual indicator such as a flashing LED on the tray.

The controller then enables the movement of the selected tray bearing the required part to extend sufficiently from the storage unit 10 to expose a zone where a required part is stored. At the same time the controller enables the unlocking of a selected cover section 16 and its retention within the storage unit 10 whereby relative to the other cover sections on the extending tray 11 that selected cover section "slides back" as the tray extends to admit access to a stored part from above the tray 11. After that part is retrieved any additional parts are released from storage in a similar way. At the end of the selected list of part retrievals the system controller re-sets to default norms and informs the user, e.g. by simply returning to the log-in screen display.

Figure 13:
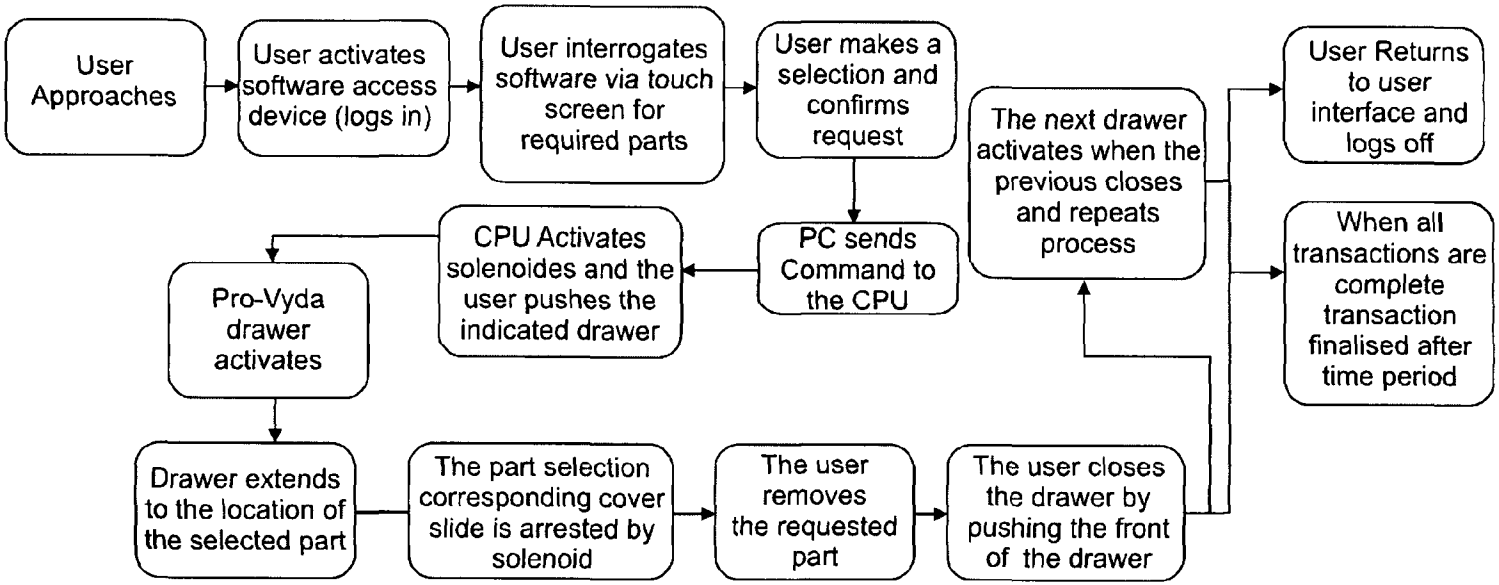
FIG. 13 is a block flow diagram representative of an embodiment of a user operating protocol for a programmable system for delivering user initiated access to selected individual trays of the secure storage unit on demand.

FIG. 13 is a block flow diagram representative of an embodiment of a user operating protocol for a programmable system for delivering user initiated access to selected individual trays of the secure storage unit on demand.

In operation, the gas strut pressure meters the speed at which the drawer opens and it also dampens the push pack of the drawer. This has the effect of preventing damage to the storage unit and increasing the mean time between failure of the drawers.

Because the ratchet solenoid 14 is centrally mounted on the drawer and moves as the drawer opens, it reduces crabbing and accompanying juddering as the drawer is opened if the drawer runners are out of alignment. Having the ratchet solenoid on the drawer has the effect of an improved weight distribution. The alternative of having solenoids mounted on the front of the storage unit would lead to sagging of the frame at the front and space would be taken up on the front face to accommodate such frame-mounted solenoids. The drawer-mounted solenoid described herein avoids such problems and also allows the front of the frame to be empty, so allowing many different configurations of draw depths. All that has to be changed is the height of the drawer side walls on a standardised drawer base, to achieve a deeper drawer.

The invention claimed is:

1. A secure storage unit comprising:

a plurality of movable trays within a housing;

a tray selector system for selectively accessing a tray on demand;

wherein the tray selector system is configured to release a selected movable tray for access by limiting an allowable extent of movement of the selected movable tray from a stowed to an accessible position with respect to the storage unit by a pre-determined amount whereby access to selected zones of selected trays is controlled;

wherein the storage unit is equipped with a tray actuator for selectively moving a tray on demand;

wherein the tray actuator is operably linked to the selected movable tray to move the selected movable tray from a stowed to a predefined accessible position with respect to the storage unit, and controlled in a predetermined way by a processor unit, wherein the predefined accessible position is provided via an interface of said processor unit; and wherein access to the storage unit is enabled by an actuator system, whereby the selected movable tray is advanced by a controlled amount by the tray actuator operably linked to that tray in cooperation with an electromechanical locking device and electromechanical locking devices mounted on the trays are controlled such that certain ones are non-energised to maintain a locked status, and a selected electromechanical locking device is energised to unlock a selected translatable cover section and passive retaining means are juxtaposed with respective translatable cover sections of a lid to enable selective retention of an unlocked translatable cover section within the storage unit when the selected tray is released from a stowed to an accessible position.

2. The secure storage unit as claimed in claim 1, wherein the selector system comprises a plurality of discrete electromechanical locking devices operably juxtaposed with respect to the trays, and configured to be individually selectable for releasing and limiting the allowable extent of movement of the selected tray with respect to the storage unit.

3. The secure storage unit as claimed in claim 1, wherein the tray is a compartmentalized drawer, wherein each compartment is configured to receive an item for storage.

4. The secure storage unit as claimed in claim 3, wherein the tray or drawer has a securable cover or lid for providing additional control over access to the tray or drawer.

5. The secure storage unit as claimed in claim 4, wherein the lid is subdivided into discrete sections.

6. The secure storage unit as claimed in claim 1, wherein access to the storage unit is enabled by use of the tray selector system for selectively accessing a tray on demand by control of electromechanical locking means, whereby a tray is released for manual movement from a stowed to an accessible position.

7. A secure storage unit comprising:

a plurality of movable trays within a secure housing is equipped with a tray actuator for selectively moving a selected movable tray on demand;

wherein the tray actuator is operably linked to the selected movable tray to move the selected movable tray from a stowed to a predefined accessible position with respect to the storage unit, and controlled in a predetermined way by a processor unit, wherein the predefined position is provided via an interface of said processor unit; and each tray has a securable cover or lid for providing additional control over access to the tray, wherein the securable cover or lid is configured to interact with discrete electromechanical locking devices associated with the trays whereby the securable cover or lid is held in place or released for movement with respect to the storage unit.

8. The secure storage unit as claimed in claim 7, wherein the tray actuator is controlled in the predetermined way by the processor in response to input from a user via the interface or in response to commands from an external control system.

9. The secure storage unit as claimed in claim 7, wherein the actuator is selected from a gas strut type, or a mechanical or hydraulic type.

10. The secure storage unit as claimed in claim 7, wherein an electro-mechanical device using a stepper motor is utilized to provide incremental movement of the tray with respect to the storage unit.

11. The secure storage unit as claimed in claim 7, wherein each tray is equipped with sensors to sense one or more of the following:

a physical interaction with the tray by a user such as a push or pull upon the tray, an insertion or removal of an item; and a non-allowed intervention such as forced access to the unit.

12. The secure storage unit as claimed in claim 7, wherein control steps comprise:

an open on demand step, and at least one of the following:

a close on command step;

a close after a timed interval;

a delay close in response to removal of an item; and a close in response to push pressure sensed upon the tray.

13. The secure storage unit as claimed in claim 7, wherein each tray is compartmentalized and each compartment is accessible via a lockable closure.

14. The secure storage unit as claimed in claim 13, wherein the lockable closure is a slidable lid which extends over one or more than one compartment in the tray.

15. The secure storage unit as claimed in claim 14, wherein the lockable closure comprises a part that interacts with an electromechanical device which when energized effects a change in locking status.

16. The secure storage unit as claimed in claim 14, wherein the lockable closures are configured for selective operation such that when one lockable closure is open, each other lockable closure is locked and cannot be opened.

17. The secure storage unit as claimed in claim 7, wherein the securable cover or lid is held in place by a magnet.

18. The secure storage unit as claimed in claim 7, wherein the storage unit is a cabinet and the trays comprise compartmented drawers within the cabinet.

19. The secure storage unit as claimed in claim 7, wherein the tray is adapted to support various modular compartmented containers.

20. The secure storage unit as claimed in claim 13, where the lockable closure is a cover plate or lid.

* * * * *